US005487413A

United States Patent [19]

Hatakeyama et al.

[11] Patent Number: 5,487,413

[45] Date of Patent: Jan. 30, 1996

[54] METHOD FOR RESTARTING THE OPERATION OF AN AIR JET LOOM, AFTER DEFECTIVE WEFT REMOVAL

[75] Inventors: Kunio Hatakeyama, Minato; Yoshihiko Habu, Kanazawa, both of Japan

[73] Assignee: Kabushiki Kaisha Ishikawa Seisakusho, Ltd., Kanazawa, Japan

[21] Appl. No.: 324,615

[22] Filed: Oct. 18, 1994

[51] Int. Cl.[6] ..... D03D 51/08; D03D 47/34

[52] U.S. Cl. ..... 139/116.2; 139/99; 139/110

[58] Field of Search ..... 139/99, 110, 116.2

[56] References Cited

U.S. PATENT DOCUMENTS

| | | | |
|---|---|---|---|
| 4,564,050 | 1/1986 | Hirano . | |
| 4,817,677 | 4/1989 | Deconinck et al. . | |
| 5,024,253 | 6/1991 | Kawabata et al. . | |
| 5,224,520 | 7/1993 | Shinbara et al. | 139/116.2 |
| 5,335,698 | 8/1994 | Berktold et al. | 139/116.2 |

FOREIGN PATENT DOCUMENTS

| | | | |
|---|---|---|---|
| 0507739 | 3/1992 | European Pat. Off. | 139/1 R |
| 1-298250 | 5/1988 | Japan | 139/116.2 |
| 1-292145 | 11/1989 | Japan | 139/116.2 |
| 3-76848 | 4/1991 | Japan . | |
| 3-185147 | 8/1991 | Japan . | |
| 4-185743 | 7/1992 | Japan | 139/1 R |

*Primary Examiner*—Andy Falik

*Attorney, Agent, or Firm*—Burns, Doane, Swecker & Mathis

[57] ABSTRACT

A loom is slowly operated in reverse rotation to move the loom to a position where a cutter is able to easily cut an improper weft when there occurs an error in the picking motion. Then, the loom is operated in normal rotation to move it to a position where the improper weft remaining in the shedding motion can be easily removed. A pick finding device is then operated to temporarily separate a main shaft and the shedding motion, and a harness frame is reversely rotated for 360°. A new weft is then inserted after the improper weft is removed from the shedding motion. In the course of the operation, a cloth fell is held at a fixed position to protect the cloth fell from being beaten by a reed. The take-up motion is then operated in normal rotation, and at the same time the let-off motion is rotated in the reverse direction at a fixed rotational ratio to provide a warp with proper tension. Thereafter, the loom, take-up motion and let-off motion are simultaneously started for restarting the weaving operation.

2 Claims, 10 Drawing Sheets

Fig.7
Fig. 7(a)
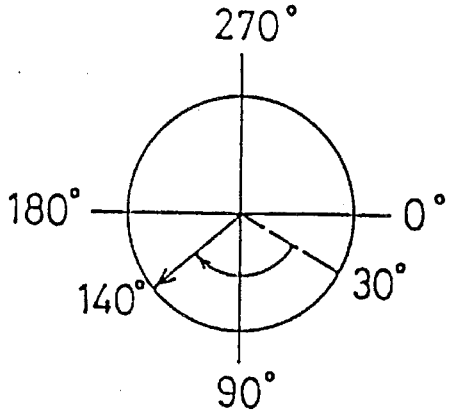
Fig. 7(b)
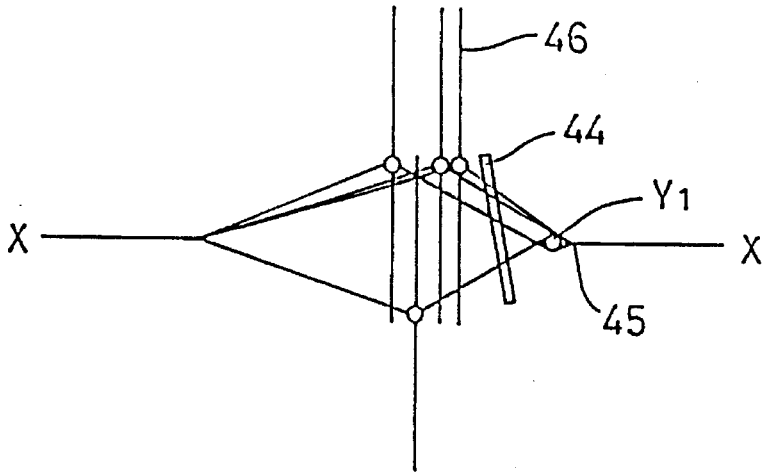
Fig. 7(c)
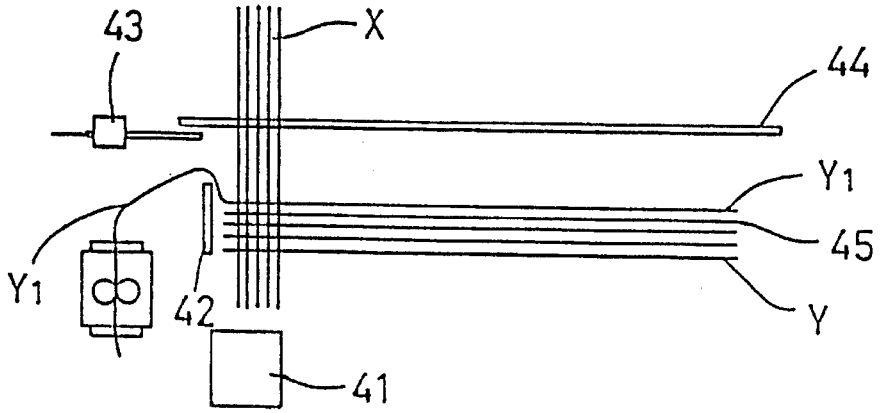
Fig. 7(d)
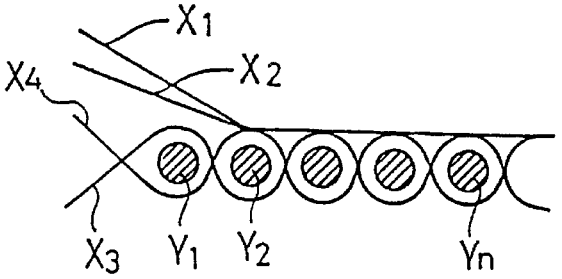

Fig.8
Fig. 8(a)
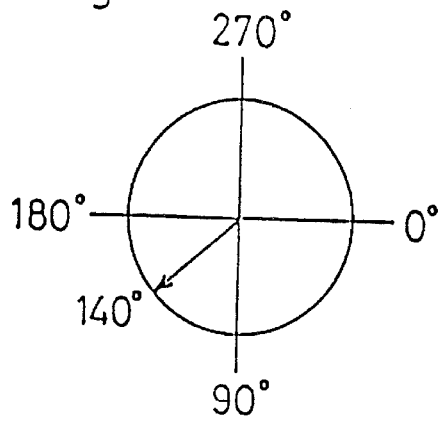
Fig. 8(b)
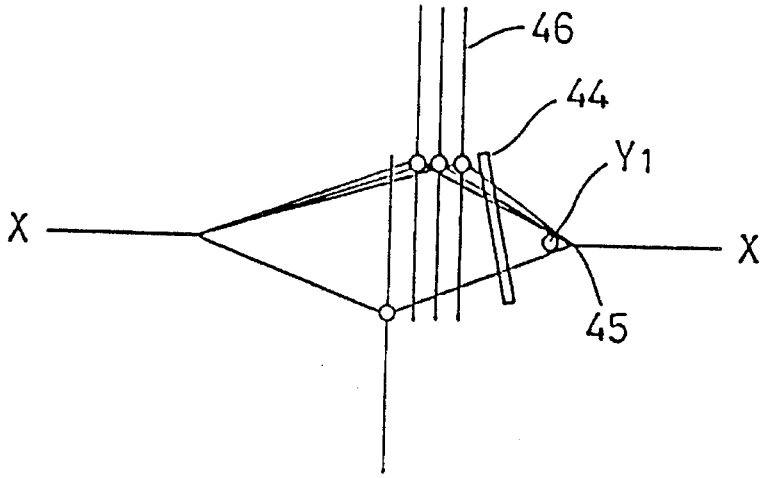
Fig. 8(c)
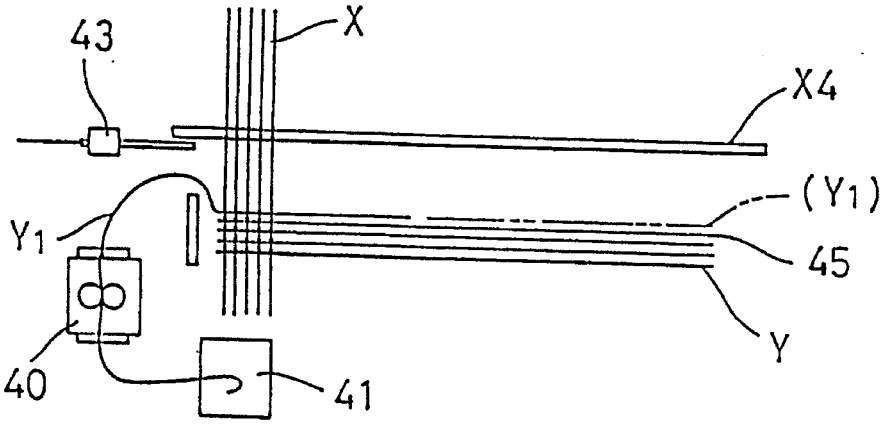
Fig. 8(d)
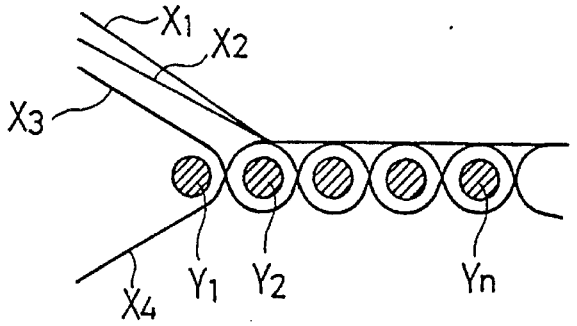

Fig.9
Fig. 9(a)
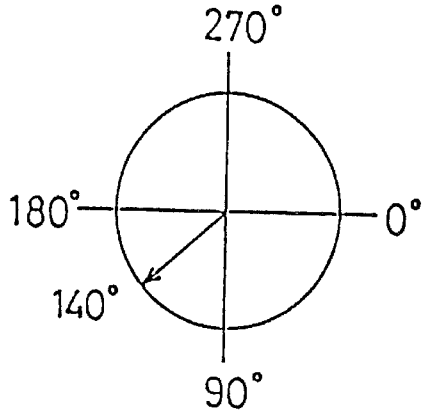
Fig. 9(b)
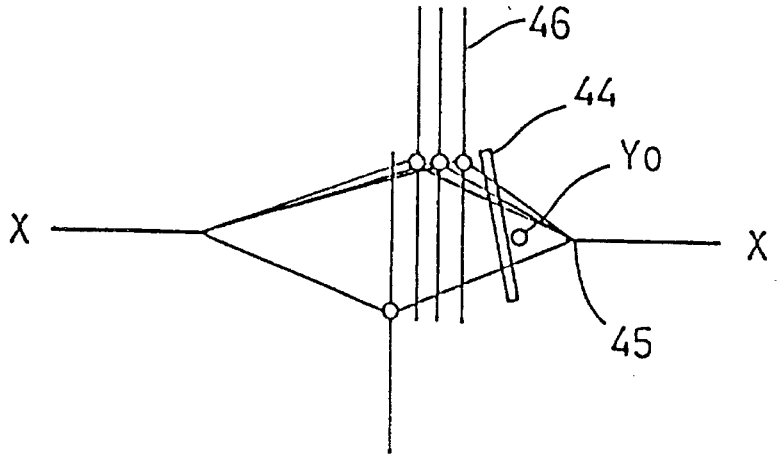
Fig. 9(c)
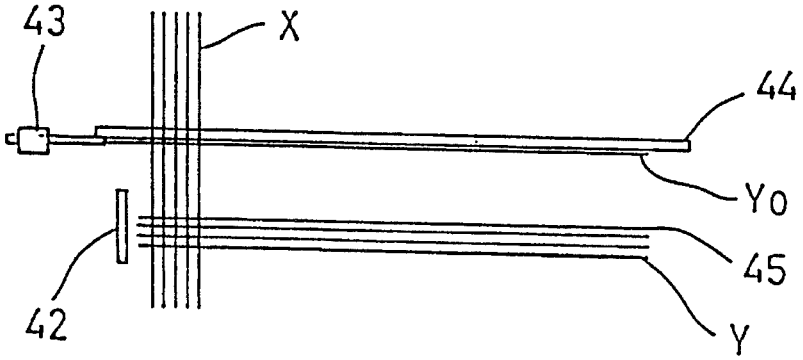
Fig. 9(d)
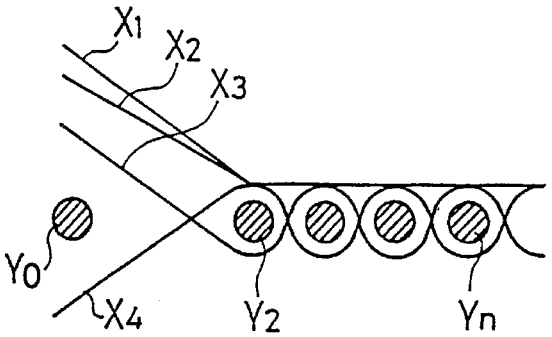

METHOD FOR RESTARTING THE OPERATION OF AN AIR JET LOOM, AFTER DEFECTIVE WEFT REMOVAL

BACKGROUND OF THE INVENTION

1. Technical Field of the Invention

The present invention relates to a method for restarting the operation of an air jet loom which is arranged to prevent the creation of unevenness on the surface of a woven fabric in a weaving process caused by various factors which originate when the loom is stopped.

2. Description of Related Art

When there occurred an error in picking motion, The general practice has been to remove an improper weft by slowly operating a loom in reverse direction after the loom is stopped. However, a weft on a cloth fell tends to slide in a vertical direction of a cloth being woven since the cloth fell in a weaving process is beaten by a reed, and a portion being woven is eventually swollen like a pillow on a woven fabric to produce unevenness on the surface of the fabric. This is of particular concern in the context of twilled fabric such as denim where swelling is easily produced.

Moreover, when a warp is left in an open shed for a long period of time during when the loom is stopped, the warp stretches with the passage of time, and when the loom is operated again thereafter, a weft on a portion of the warp is floated to result in creating the swelling thereat.

Various attempts have heretofore been undertaken to solve the creation of such swelling in a weaving process. Japanese Published Unexamined Patent Application No. 3-76848/1991, for instance, discloses changing a positional relation between a cloth fell and a reed in order that the cloth fell is not beaten by the reed when a loom is operated slowly. As a prior art related to warp yarn, Japanese Published Unexamined Patent Application No. 3-185147/1991 discloses driving only a shedding motion independently in order not to add high tension to a warp being left in an open shed of warps for a long period of time when a loom is stopped.

Even in a conventional method, when a light denim which weighs somewhere up to 13 ounce is woven, there appears no conspicuous swelling. However, when a heavy denim weighing somewhere around 15 ounce is woven, there is a tendency to show conspicuous swelling, and it obstructs the denim weaving operation by the air jet loom.

SUMMARY OF THE INVENTION

An object of the present invention is to provide a method for restarting the operation of an air jet loom after the loom is temporarily stopped so that the creation of swelling on the surface of a woven fabric is prevented even when a heavy denim which weighs more than 15 ounces is woven.

In order to accomplish the object, the following steps are taken in sequence when there occurs an error in the picking motion, and an improper weft is removed for restarting the operation of an air jet loom after the loom is temporarily stopped.

a. First, the loom is stopped at approximately 300° in the rotational angle of a main shaft, and the loom is then rotated in reverse direction from 300° to approximately 30° in the rotational angle of the main shaft.

b. An improper weft stretching from a main nozzle into a shed of warps is then cut with a cutter disposed adjacent to the main nozzle.

c. The loom is then operated slowly in normal rotation from 30° to 140° in the rotational angle of the main shaft.

d. A pick finding device is operated to separate the main shaft and a shedding motion, and after only a harness frame is reversely rotated for 360°, the main shaft and the shedding motion are connected again.

e. Then, an improper weft in the shed of warps is removed with an improper weft removing device, and a new weft is inserted into the shed of warps by injecting pressurized air.

f. A take-up motion is then operated in normal rotation while the loom is stopped, and at the same time, a let-off motion is operated in reverse rotation. At this stage, a rotational ratio between the normal and reverse rotation is preliminarily fixed.

g. Thereafter, the loom, take-up motion and let-off motion are simultaneously started for resuming an operation.

When the loom is slowly operated to remove an improper weft after the loom is temporarily stopped, if a reed beats a cloth fell, a weft is slipped in a vertical direction of a cloth being woven and easily creates unevenness on the surface of a woven fabric. It is, therefore, necessary to arrange that the reed does not beat the cloth fell to avoid the creation of unevenness. The reason why the loom is rotated in the reverse direction from 300° to 30° during the slow operation of the loom is that the improper weft can be cut easily.

Then, the loom is operated in the normal rotation from 30° to 140°, and only the shedding motion is operated by operating the pick finding device whereby an improper weft can be easily removed. The reason why the let-off motion is reversely rotated while the take-up motion is operated the in normal rotation at a fixed rotational ratio after a new weft is inserted in place of the improper weft and immediately before the loom is restarted is that, by so doing, a beating force of the reed is regulated by giving a proper tension to a warp when the loom is restarted.

These and other objects and features of the present invention will become more apparent from the following description taken in conjunction with the accompanying drawings which illustrate specific embodiments of the invention.

BRIEF DESCRIPTION OF THE DRAWINGS

FIGS. 7*a–7d* are explanatory views showing the disposition of various elements between the time 14 and 15 depicted in FIG. 4.

FIGS 8*a–8d* are explanatory views showing the removal of the improper weft.

FIGS. 9*a–9d* are explanatory views showing the disposition of various elements during drawing out of the new weft.

DESCRIPTION OF THE PREFERRED EMBODIMENT description will now be set forth concerning an embodiment of the present invention with reference to accompanying drawings.

Figure 1:
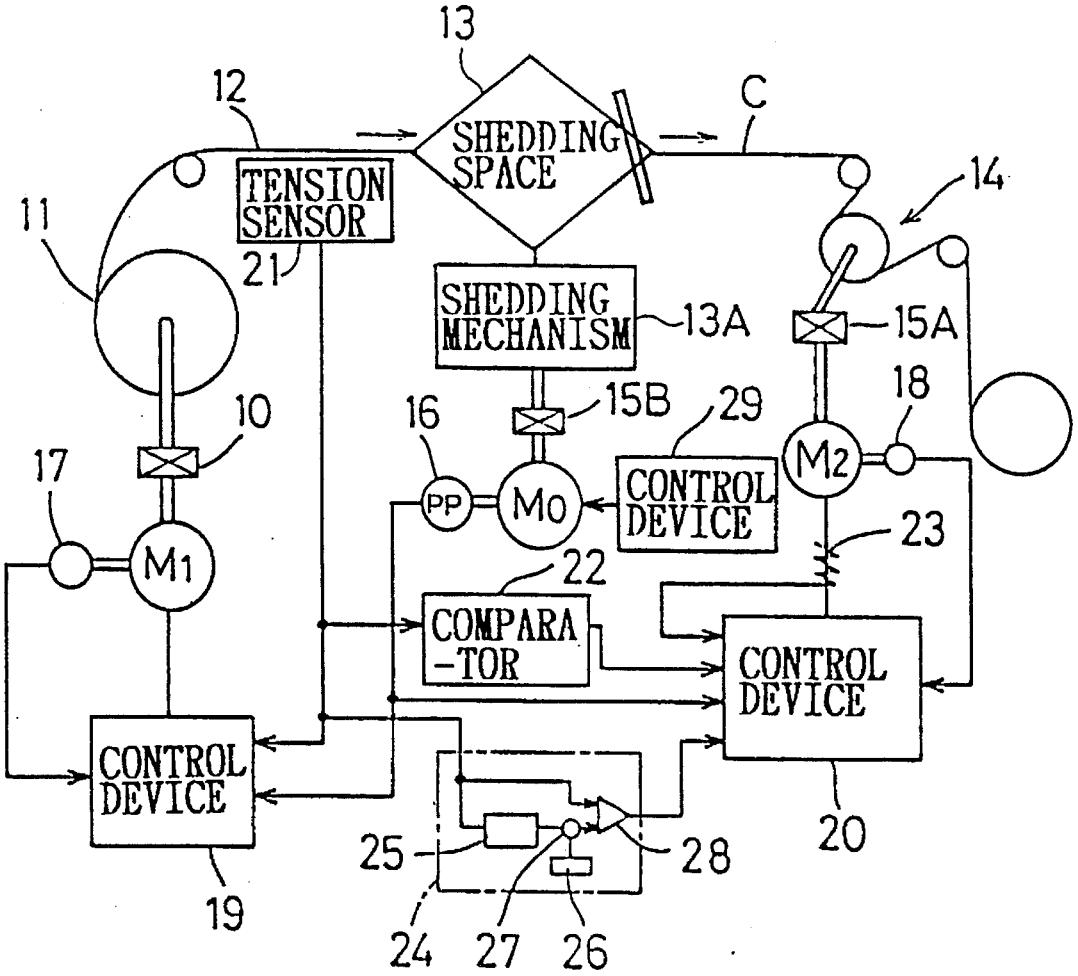
FIG. 1 is a view schematically showing a construction of an air jet loom which is applied to an embodiment of the present invention.

In FIG. 1, numeral 11 represents a let-off motion which is driven by a variable speed motor M1 through a reduction gear 10. A shedding motion 13 provided with a shedding mechanism 13A separates warps 12 forwarded from the let-off motion 11 into two groups, a lower group and an upper group, and a fabric C is manufactured by running wefts through the shedding motion.

Numeral 14 represents a take-up motion which is driven by a variable speed motor M2 through a reduction gear 15A, and the fabric C forwarded out of the shedding motion is taken up thereat.

The shedding mechanism 13A, i.e. the loom side, is arranged to be driven by a variable speed motor M0 through a reduction gear 15B. The motor M0 for driving the loom, the motor M1 for driving the let-off motion, and the motor M2 for driving the take-up motion are provided with their respective sensors 16, 17, 18, for detecting the number of rotations.

An electric current sensor 23 is provided for detecting a value of current of the take-up motion driving motor M2. A signal from the sensor 16 which is provided for detecting the number of rotations is inputted into control devices 19, 20, provided for the let-off motion driving motor M1 and the take-up motion driving motor M2. A signal from the sensor 17 which is provided for detecting the number of rotations is inputted into the control device 19, and signals from the sensor 18 which is provided for detecting the number of rotations and the electric current sensor 23 are inputted into the control device 20. The loom driving motor M0 is controlled by a control device 29. The control units 29, 19, 20, are arranged to reciprocally receive synchronous signals for controlling the timing of each one of the variable speed motors M0, M1, and M2.

A tension sensor 21 for detecting the tension of a warp 12 is provided, and a tension feedback signal from the tension sensor 21 is inputted into the control device 19 as well as into a comparator 22 and an increased tension detecting circuit 24.

The comparator 22 outputs an "L" signal to the control device 20 as long as a signal from the tension sensor 21 is larger than a fixed value (for example, the lowest value of tension permissible by a structure). However, when a signal from the tension sensor 21 becomes smaller than the fixed value, an "H" signal is transmitted to the control device 20. The control device 20 acts to stop the operation of the take-up motion driving motor M2 when the "H" signal is transmitted from the comparator 22.

The increased tension detecting circuit 24 is provided with a storage circuit 25 for storing a value when a tension value transmitted from the tension sensor 21 reaches a fixed value, an adding circuit 27 for adding a fixed value from a fixed value setting circuit 26 to a stored value from the storage circuit 25, and a comparator 28 for receiving signals from the adding circuit 27 and the tension sensor 21.

The comparator 28 outputs an "L" signal to the control device 20 as long as a signal from the tension sensor 21 is smaller than a signal level from the adding circuit 27 (a signal to which a fixed value is added to a stored value). However, when the signal from the tension sensor 21 becomes larger, an "H" signal is transmitted to the control device 20. When the "H" signal is output from the comparator 28, the control device 20 acts to stop the operation of the take-up motion driving motor M2.

With an arrangement described above, at the time of regular operation, the loom side, i.e. the side of the shedding mechanism 13A is operated by the loom driving motor M0, and the let-off motion side 11 is operated by controlling a tension based on a tension feedback signal from the tension sensor 21. The take-up motion side 14 is operated at a velocity corresponding to the loom by controlling the electric current based on a signal from the electric current sensor 23.

Figure 2:
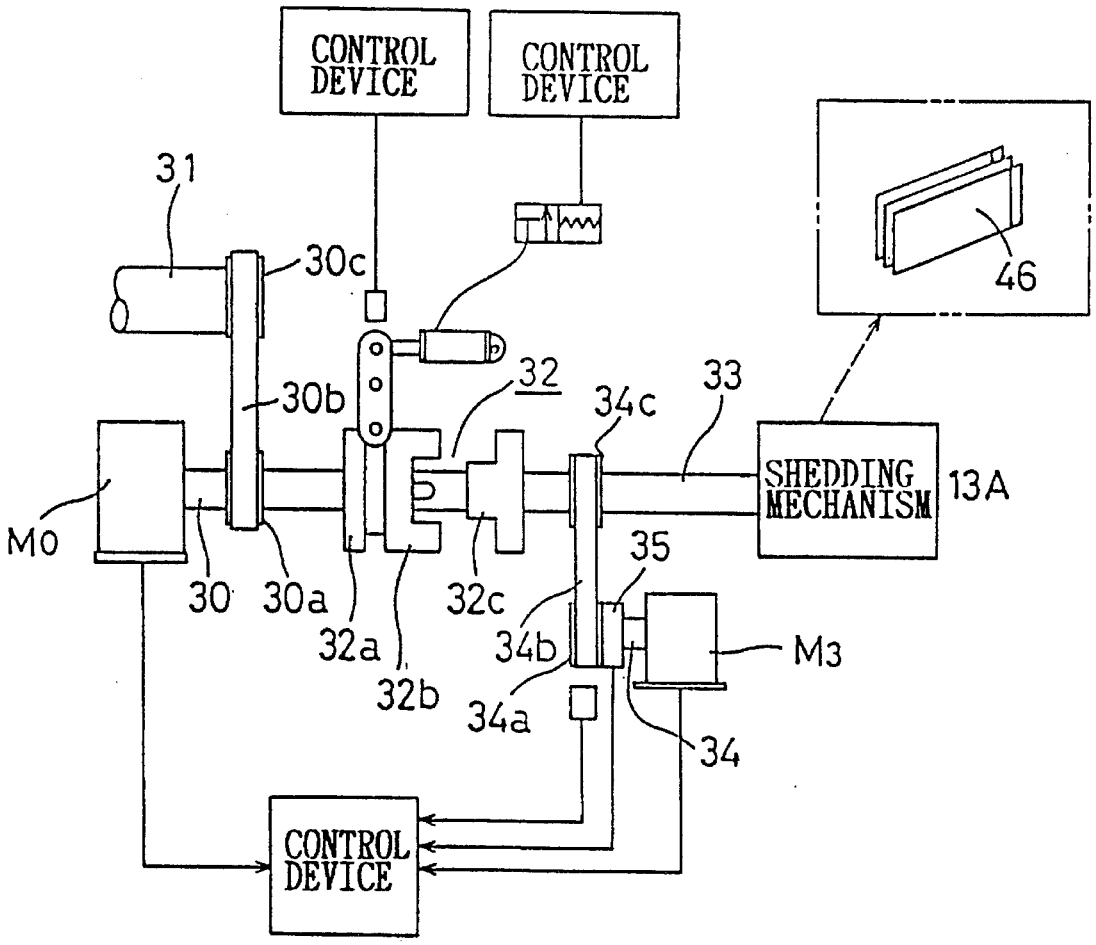
FIG. 2 is a view schematically showing a pick finding device.

An air jet loom which is applied to the present embodiment is provided with a pick finding device, the construction of which is schematically illustrated in FIG. 2. A driving force of the loom driving motor M0 is transmitted to a main shaft 31 through an output pulley **30*a*, belt 30*b* and input pulley 30*c* attached to a rotating shaft 30** whereby a reed is driven.

On the other hand, on the right side portion in the figure where the rotating shaft 30 of the loom driving motor M0 is extended, the main shaft 31 side and the shedding mechanism 13A side are separably connected by an electrode clutch 32. A drive motor M3 is provided as a driving source for independently driving the shedding mechanism 13A only, and the driving force of the rotating shaft 34 of the motor M3 is transmitted to a driving shaft 33 through a clutch 35, an output pulley **34*a*, belt 34*b* and input pulley 34*c* to drive the shedding mechanism 13A**.

Figure 3:
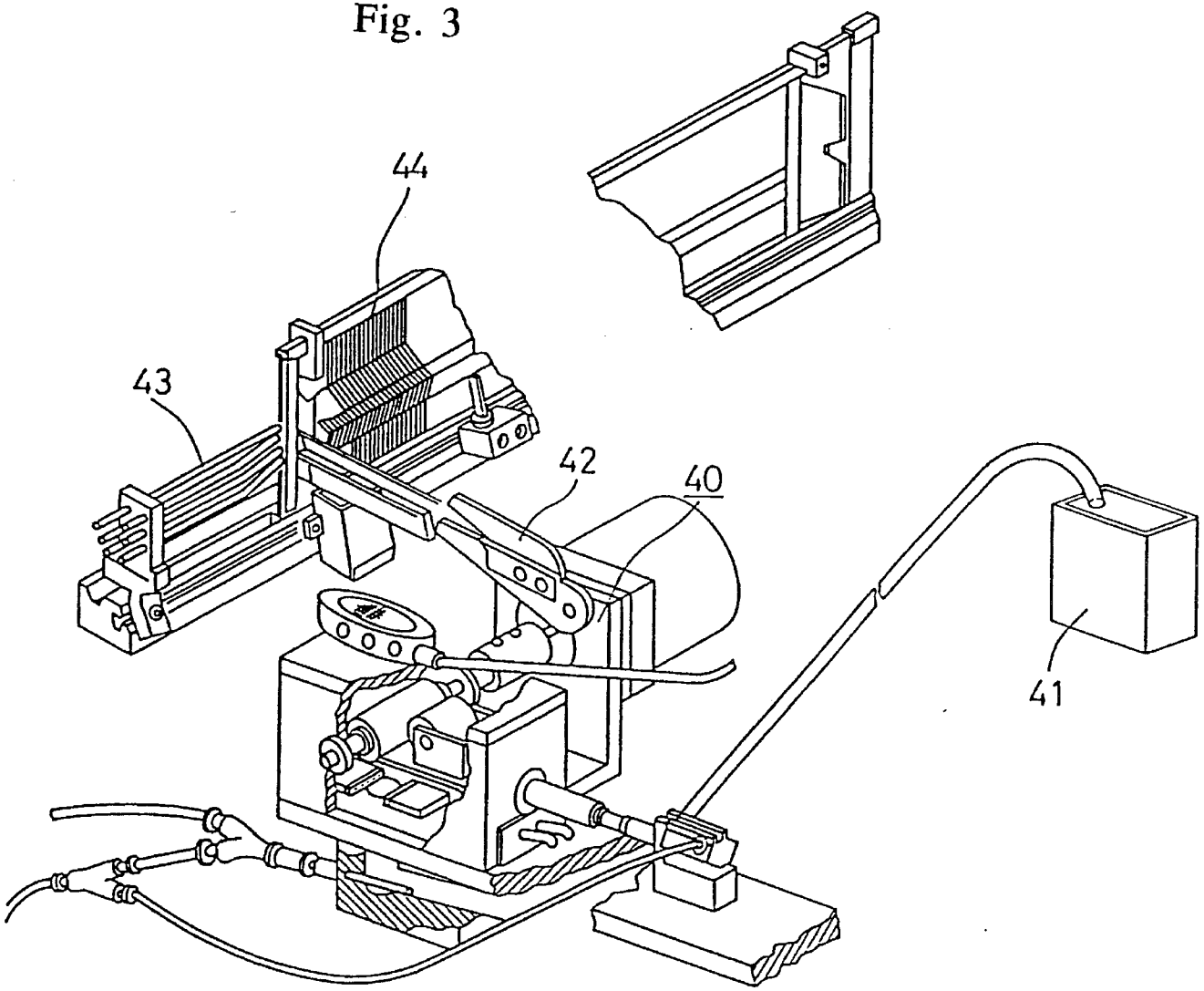
FIG. 3 is a perspective view showing the main part of an improper weft removing device.

The air jet loom which is applied to the present embodiment is also provided with an improper weft removing device 40, the construction of which is schematically illustrated in FIG. 3. The device 40 is arranged to take out an improper weft remaining in the shedding motion and discharge the weft into a box 41. Such an improper weft removing device 40 is necessarily provided with an air jet loom being manufactured lately and is known well. In the present embodiment, an improper weft removing device which is proposed and disclosed in U.S. Pat. No. 5,046,532 issued on Sep. 10, 1991 to the applicant of the present invention is exemplified. A detailed description will, therefore, be omitted.

When there occurs an error in the picking motion, it is necessary to stop the loom immediately and start the loom again after an improper weft is removed. At this stage, the operation for restarting the loom is conducted in the following order.

Figure 4:
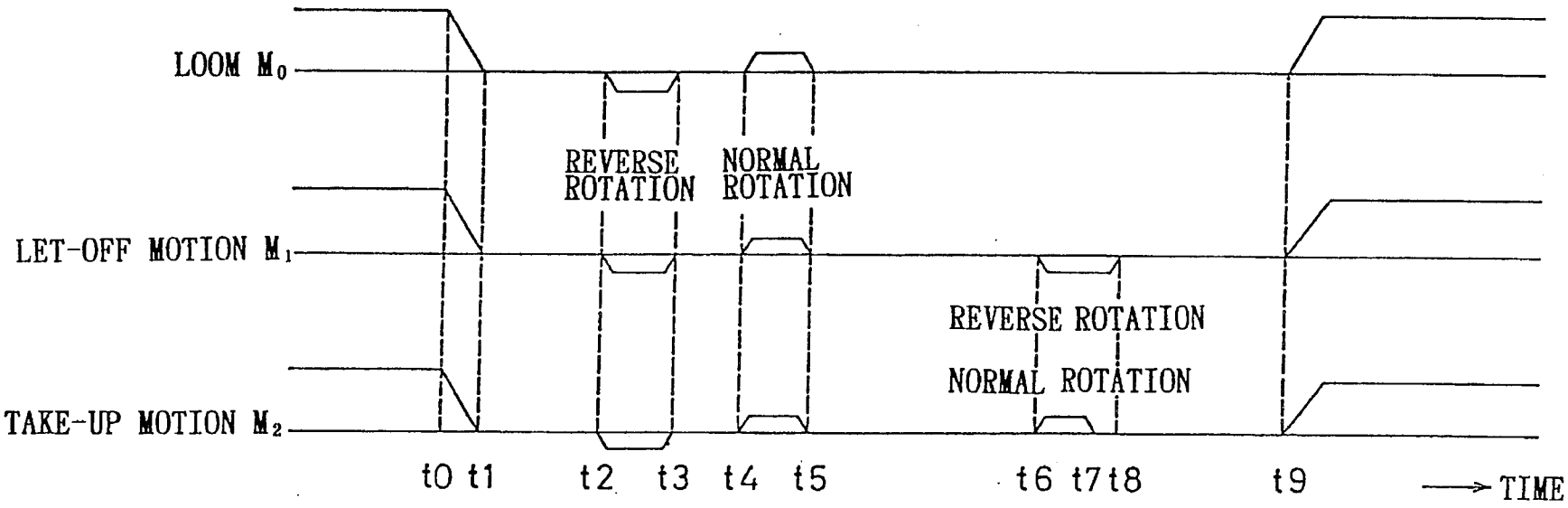
FIG. 4 is a time chart explaining how the present invention works.
Figure 5A:
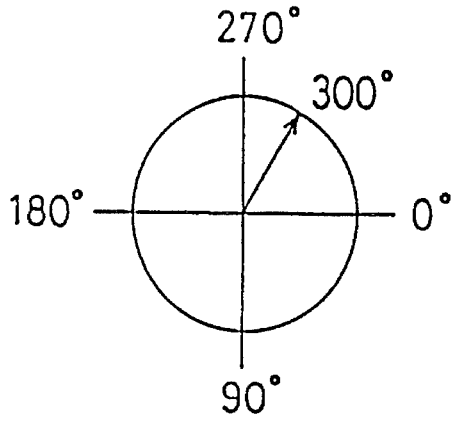
FIGS. 5*a–5d* an explanatory views showing are the disposition of various elements at the time t1 depicted in FIG. 4
Figure 5B:
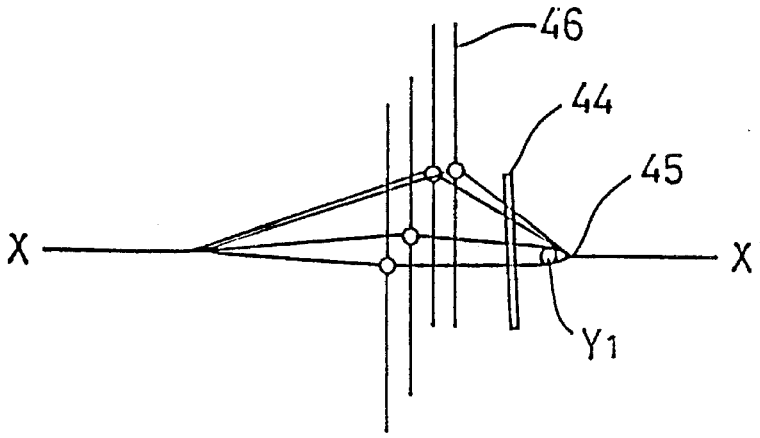
Figure 5C:
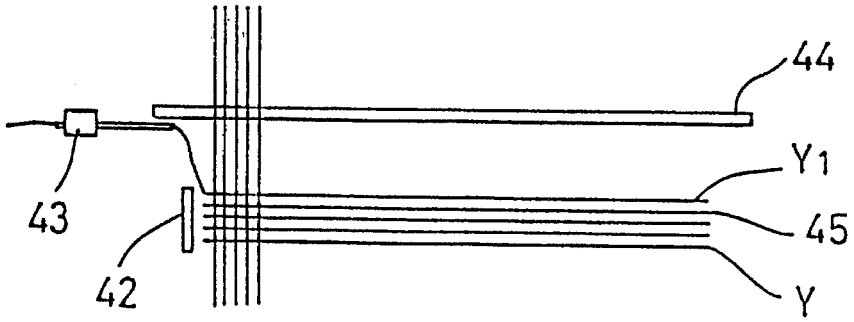
Figure 5D:
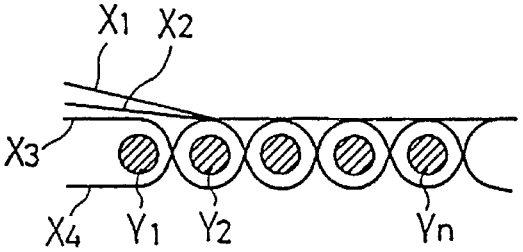
Figure 6A:
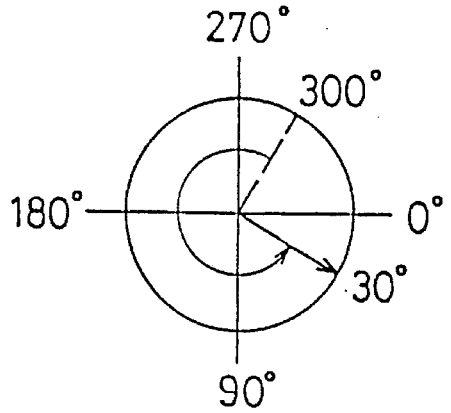
FIGS. 6*a–6d* are explanatory views showing the disposition of various elements between the time t1 and 13 depicted in FIG. 4.
Figure 6B:
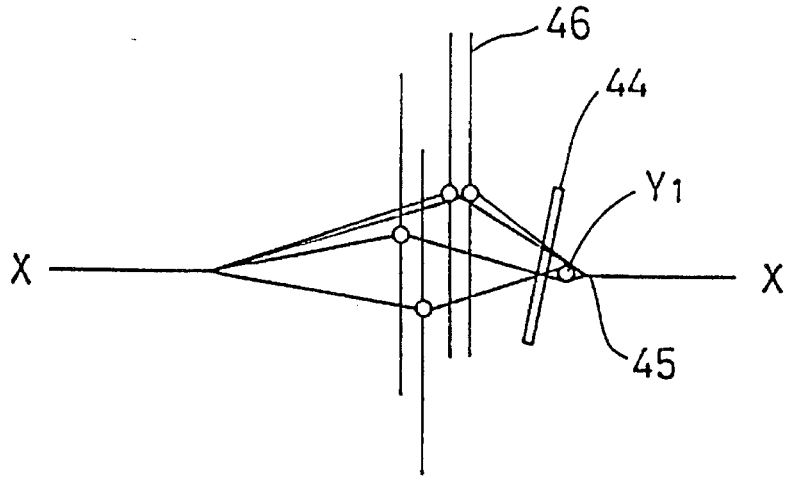
Figure 6C:
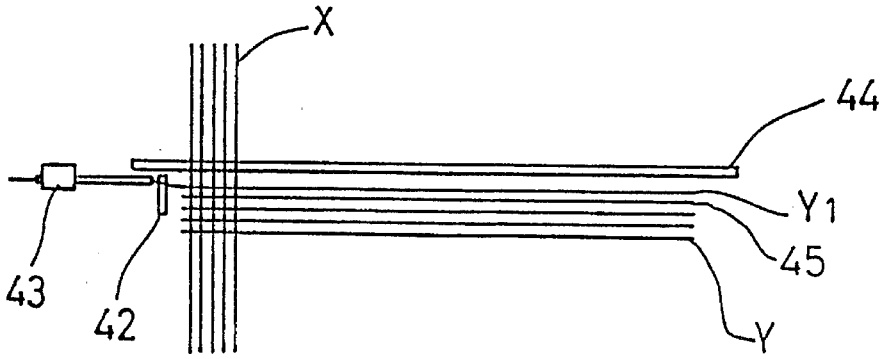
Figure 6D:
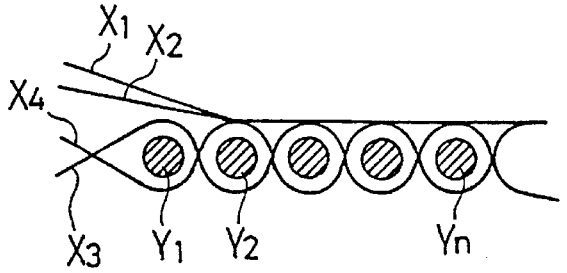

Referring to FIG. 4, when the occurrence of an error in the picking motion is detected at time tO, the loom driving motor M0, let-off motion driving motor M1 and take-up motion driving motor M2 are stopped at time t1. At this stage, the loom is stopped approximately at 300° with respect to the rotational angle of the main shaft 31 as shown in FIG. 5 (*a*). The relation between warp X and weft Y in the shedding motion at this time is illustrated in sectional side view in FIG. 5 (*b*). The condition of surroundings of the cloth fell 45 is shown by plan view in FIG. 5 (*c*). At this stage, there is a certain distance between a reed 44 and cloth fell 45. When the relation between warps X and wefts Y adjacent the cloth 45 is viewed in transverse sectional view, warps X3, X4 are open relative to an improper weft Y1 as shown in FIG. 5 (*d*).

During the time between t2 and t3 shown in FIG. 4, the entire loom (loom, let-off motion and take-up motion) is operated slowly in reverse rotation from 300° to 30° in the rotational angle of the main shaft 31 as shown in FIG. 6 (*a*) whereby a cutter 42 provided for cutting a weft is positioned at a suitable location to cut an improper weft easily.

A positional relation between the cloth fell 45 and reed 44 at this stage is shown in FIGS. 6 (*b*) and 6 (*c*) wherein the reed 44 comes close to the cloth fell 45, however, the cloth fell 45 is not beaten by the reed 44 during this slow operation. The relation between warps X and wefts Y at this time is shown in FIG. 6 (*d*) wherein warps X3 and X4 are crossed relative to an improper weft Y1. Under this state, the improper weft Y1 running from the main nozzle 43 into the shedding motion is cut by the cutter 42 provided adjacent to the main nozzle 43.

During the time between t4 and t5 shown in FIG. 4, the entire loom is operated slowly in normal rotation from 30° to 140° in the rotational angle of the main shaft 31 as shown in FIG. 7 (*a*) whereby the improper weft Y1 cut by the cutter 42 and remained in the shedding motion can be removed easily.

A positional relation between the cloth fell 45 and reed 44 at this stage is illustrated in FIGS. 7 (*b*) and 7 (*c*) wherein the reed 44 moves away from the cloth fell 45 so that the reed 44 does not beat the cloth fell 45 thereby preventing the occurrence of unevenness on the surface of a woven cloth. The relation between warps X and wefts Y is shown in FIG. 7 (*d*) wherein warps X3 and X4 are under a state that they are still crossed relative to an improper weft Y1.

The pick finding device illustrated in FIG. 2 is then operated to separate the main shaft 31 and the shedding mechanism 13A, and after reversely rotating only the harness frame 46 for 360°, the main shaft 31 and the shedding mechanism 13A are connected again whereby the crossed warps X3 and X4 illustrated in FIG. 7 (*d*) are open to easily remove the improper weft Y1 as shown in FIG. 8 (*d*) .

Then, the improper weft Y1 in the shedding motion is removed with the improper weft removing device 40 shown in FIG. 3. More particularly, the improper weft Y1 in the shedding motion is adsorbed by the improper weft removing device 40 and is discharged into a box 41. The main shaft 31 at this stage is left stopped at a position of 140° as shown in FIG. 8 (*a*), and the positional relation between the reed and cloth fell remains unchanged as illustrated in FIGS. 7 (*b*) and 8 (*b*). The cloth fell 45 is thus not beaten by the reed 45. The relation between wefts Y and warps X is shown in FIG. 8 (*d*) wherein the warps X3, X4 are kept under the state of open shedding.

A new weft YO is then drawn out from a weft storage device (not shown) to insert the weft into the shedding motion by pressurized air injected from the main nozzle 43. The relation between warps X and wefts Y at this stage is shown in FIG. 9 (*d*).

Figure 10:
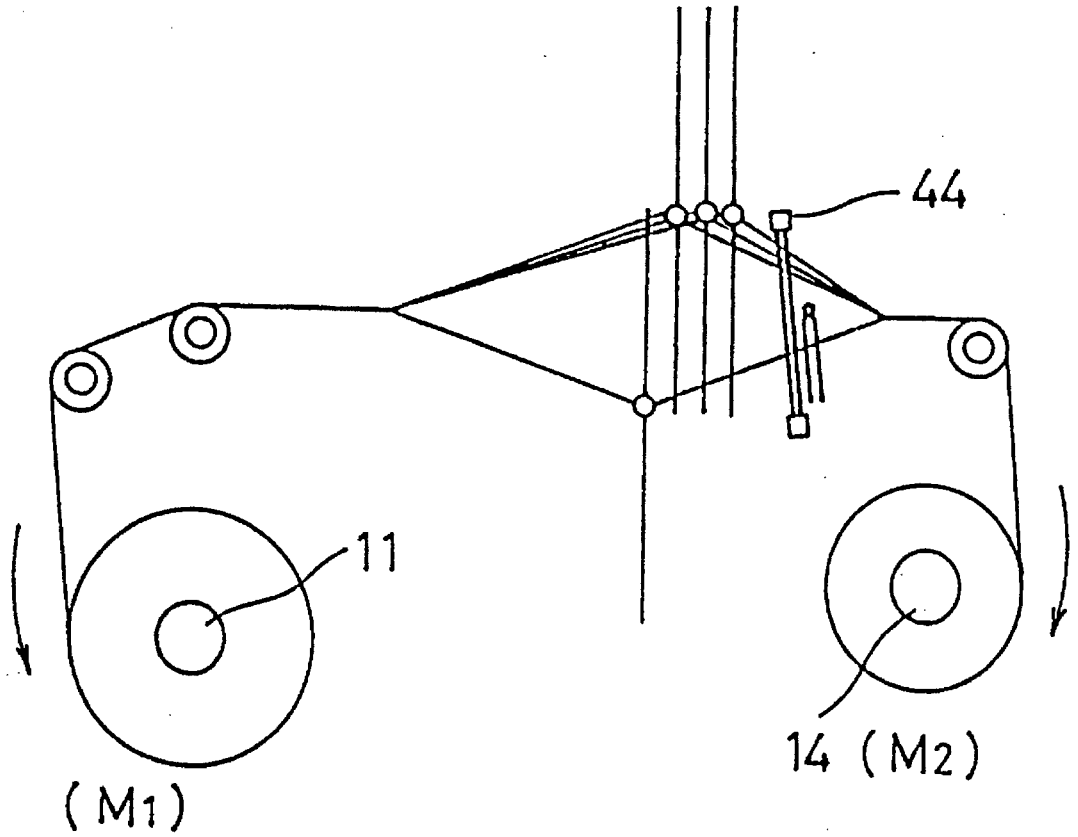
FIG. 10 is is a schematic illustration of the let-off motion and take-up motion during operation.

During the time from t6 to t8 shown in FIG. 4, the take-up motion 14 is operated in normal rotation while the loom is stopped as shown in FIG. 10, and at the same time, the let-off motion 11 is rotated in the reverse direction. At this stage, a rotational ratio between normal and reverse rotations is set at a preliminarily fixed ratio. In other words, the rotational ratio differs depending on a weaving condition, and is determined by experience through trial and error.

For a denim which weighs 15 ounces for instance, in the case when it consists of No. 6S count cotton warp yarn with density of 64 yarns/inch and No. 6S count cotton weft yarn with density of 44 yarns/inch, and is woven at a weaving speed of 650rpm, a ratio in the rotational angle between reverse rotation of the let-off motion and normal rotation of the take-up motion is approximately 7:1–3:1, preferably 4:1. A distance the take-up motion and let-off motion moved at this stage is counted somewhere from 1mm to 2mm in total.

Thereafter, at the time t9 shown in FIG. 4, the loom driving motor M0, the take-up motion driving motor M2 and the let-off motion driving motor M1 are simultaneously started for restarting the wearing operation.

As described above, when the loom is restarted after removing the improper weft out of the shedding motion, there are made arrangements in a course of operation for inserting a new weft in place of an improper weft wherein the cloth fell is not beaten by the reed relative to wefts, and a proper tension is added to warps prior to restarting the loom so that even if a heavy denim weighing more than 15 ounces is woven, there appears almost no unevenness on the surface of a woven fabric even in a denim weaving process compared with conventional weaving methods, and a fine woven fabric is manufactured.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A method for restarting the operation of an air jet loom which is provided with a pick finding device and an improper weft removing device, wherein a loom, a let-off motion and a take-up motion each have their own independent driving source, for removing an improper weft when there occurs an error in a picking motion in an air jet weaving operation, comprising steps in the following order of:

a. stopping the loom at approximately 300° with respect to the rotational angle of a main shaft, and then rotating the loom in a reverse direction from 300° to approximately 30° with respect to the rotational angle of the main shaft;

b. cutting an improper weft stretching from a main nozzle into a shedding motion with a cutter provided adjacent to the main nozzle;

c. operating the loom in a normal rotational direction from 30° to approximately 140° with respect to the rotational angle of the main shaft;

d. operating the pick finding device to separate the main shaft and the shedding motion, and once again connecting the main shaft and the shedding motion after reversely rotating only a harness frame for 360°;

e. removing an improper weft remaining in the shedding motion with the improper weft removing device, and inserting a new weft into the shedding motion by injecting pressurized air from the main nozzle;

f. operating the take-up motion in normal rotation while the loom is stopped, and at the same time, rotating the let-off motion in reverse rotation, wherein a ratio between said normal and said reverse rotations is from 1:7 to 1:3; and g. restarting the weaving operation by simultaneously starting the loom, take-up motion and let-off motion.

2. A method for restarting the operation of an air jet loom as defined in claim 1, wherein the ratio between said normal and reverse rotations is approximately 1:4.

* * * * *